United States Patent [19]

Heine et al.

[11] Patent Number: 4,522,388

[45] Date of Patent: Jun. 11, 1985

[54] ARRANGEMENT FOR APPLYING COMPRESSED AIR TO UNDERSIDE OF SHEET ON FEED TABLE OF PRINTING PRESS

[75] Inventors: Heinrich Heine, Gutersloh; Georg Herzan, Sulzbach; Fred Kunkel, Offenbach am Main, all of Fed. Rep. of Germany

[73] Assignee: M.A.N.-Roland Druckmaschinen Aktiengesellschaft, Fed. Rep. of Germany

[21] Appl. No.: 509,367

[22] Filed: Jun. 30, 1983

Related U.S. Application Data

[63] Continuation-in-part of Ser. No. 471,503, Mar. 2, 1983, abandoned.

[30] Foreign Application Priority Data

Mar. 13, 1982 [DE] Fed. Rep. of Germany ..... 3209259

[51] Int. Cl.[3] ..... B41F 21/12; B65H 9/04

[52] U.S. Cl. ..... 271/245; 271/195

[58] Field of Search ..... 271/245, 246, 247, 250, 271/248, 195, 97, 236, 237; 406/83, 88; 239/533.13, 533.14, 517, 519, 455; 294/64 B

[56] References Cited

U.S. PATENT DOCUMENTS

| | | | |
|---|---|---|---|
| 3,370,847 | 1/1968 | Weidman | 271/229 |
| 3,624,807 | 11/1971 | Schwebel | 271/236 |
| 3,721,472 | 3/1973 | Mammel | 271/195 X |
| 3,779,545 | 12/1973 | Schuhmann et al. | 271/183 |
| 3,933,351 | 1/1976 | Mayer et al. | 271/183 |
| 4,171,131 | 10/1979 | Stange et al. | 271/236 |
| 4,260,149 | 4/1981 | Melzer | 271/236 |
| 4,270,702 | 6/1981 | Nicholson | 239/455 |
| 4,328,961 | 5/1982 | Wegel | 271/236 |
| 4,355,800 | 10/1982 | Sugiyama | 271/245 X |

FOREIGN PATENT DOCUMENTS

| | | |
|---|---|---|
| 1186473 | 2/1965 | Fed. Rep. of Germany . |
| 2638784 | 3/1978 | Fed. Rep. of Germany . |

*Primary Examiner*—Bruce H. Stoner, Jr.
*Assistant Examiner*—Alvin Oberley
*Attorney, Agent, or Firm*—Leydig, Voit, Osann, Mayer & Holt, Ltd.

[57] ABSTRACT

A sheet feeding assembly for a printing press including a feed table having a set of front stops and which is inclined downwardly so that a sheet travels toward the front edge of the table where it is temporarily retained in registered position. A port connected to a source of compressed air extends through the table at a position spaced from the front edge of the table. A rear feed plate is seated on the table upstream of the port and a front feed plate is seated on the table downstream of the port, the plates being substantially coplanar with their respective front and rear edges in proximity and uniformly spaced with respect to one another. The front edge portion of the rear feed plate is undercut to form an overhang which defines a transversely extending air conducting cavity which overlaps the port so that an air blast is directed at an angle upwardly and forwardly of the table to lubricate the passing sheet and to urge the sheet in the direction of the front stop. The rear plate is adjustably shiftable to vary the spacing between the plates thereby to vary the rate of discharge of the air. A manually adjustable cam elevates the front edge of the rear plate to a variably upraised position thereby to vary the angle of discharge of the air against the sheet.

9 Claims, 10 Drawing Figures

ARRANGEMENT FOR APPLYING COMPRESSED AIR TO UNDERSIDE OF SHEET ON FEED TABLE OF PRINTING PRESS

CROSS REFERENCE TO RELATED APPLICATION

This application is a continuation-in-part of application Ser. No. 471,503 filed Mar. 2, 1983 now abandoned.

BACKGROUND OF THE INVENTION

1. Field of the Invention

This invention relates generally to sheet-fed printing machines, and more particularly to a sheet feed mechanism.

2. Description of the Background Art

In a high speed sheet fed press having a number of press units for multi-color printing one of the most troublesome problems is to feed a sheet into position accurately and with proper timing at each of the press units thereby to ensure exact register of successively printed impressions. German patent specification No. 1,186,473 teaches use of an air blast in a feed table directed substantially parallel to the table with the intention to hold down and at the same time propel the successive sheets by combined blast-suction effect. A disadvantage of the disclosed arrangement is that it cannot be satisfactorily adapted to different conditions or different materials as, for example, the thickness, stiffness and surface texture of the sheets being handled, or the amount and distribution of moisture in the sheet which may cause waviness at the sheet edges. Finally, a smooth feed plate is used which is found to produce an overly thick cushion of air under the sheet which may produce flutter and whistling of the sheet and even loss of control when handling lightweight grades of paper.

Use of jets of air in a feed table is also taught in U.S. Pat. No. 3,370,847. While this patent does show adjustability of the angle of discharge, the jets are concentrated and spaced along the width dimension of the sheet, and therefore engage the sheet only at widely separated intervals rather than uniformly, resulting in point-to-point variations along the sheet making it difficult to adjust for sheets of light and heavy gauge. Since a smooth feed table is used the arrangement exhibits the same problem of an overly thick cushion of air noted in connection with the above-mentioned German patent. Moreover, because of use of individual nozzles the device consists of numerous parts and is inherently of flimsy construction giving rise to maintenance problems.

SUMMARY OF THE INVENTION

It is, accordingly, an object of the present invention to provide an air blast arrangement for a feed table in which the air blast is applied uniformly and continuously along the entire width dimension of the sheet, in which the angle that the air is applied to the sheet and the rate of discharge of the air along each increment of sheet width may be conveniently and uniformly varied in accordance with the gauge, surface texture and condition of the sheets being handled to optimize the effect upon each sheet and to ensure that each sheet is deposited on the front stop in a precise position and with proper timing even at highest press speeds. In this connection, it is an object to provide means for producing an air blast which extends continuously and uniformly along the width dimension of the sheet in which the angle of application is continuously variable along the width dimension and in which such angle, as well as the rate of discharge of the air, may be accurately varied to achieve a desired and reproducible condition even while the press is in operation, enabling the arrangement to be immediately adapted to any sudden variation in, for example, the condition of the paper.

It is a more specific object to provide an air blast arrangement for a feed table which utilizes air at high flow levels but in which the thickness of the resulting air cushion is minimized, reducing the tendency toward fluttering or whistling and ensuring positive control of each sheet until it reaches the point of pickup at the front stops. In this connection, it is an object to provide an arrangement employing an air blast which achieves an optimum degree of lubrication and cushioning of the sheet and an optimum degree of suction, or holddown, of the sheet over a wide range of sheet thickness and texture and without developing flutter or producing electrostatic effects.

Generally stated, it is an object of the invention to provide an arrangement for applying an air blast to a stream of sheets passing over a feed table which is not only effective and adaptable to all conditions which may be encountered but which is inherently simple and economical in construction, free of vibration, and capable of use without maintenance over long periods of time.

DESCRIPTION OF THE PREFERRED EMBODIMENTS

Other objects and advantages of the invention will become apparent upon reading of the attached detailed description and upon reference to the drawings in which.

Figure 3:
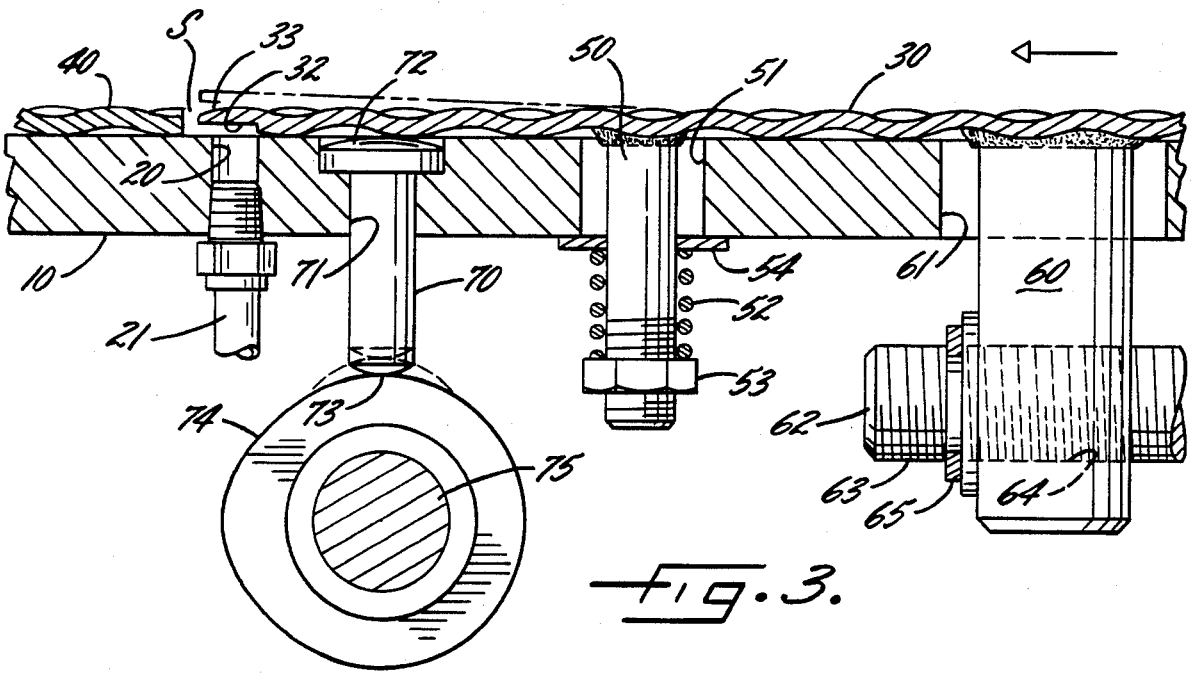
FIG. 3 is an enlargement of the portion of FIG. 1 outlined by the dot dash line.
Figure 3A:
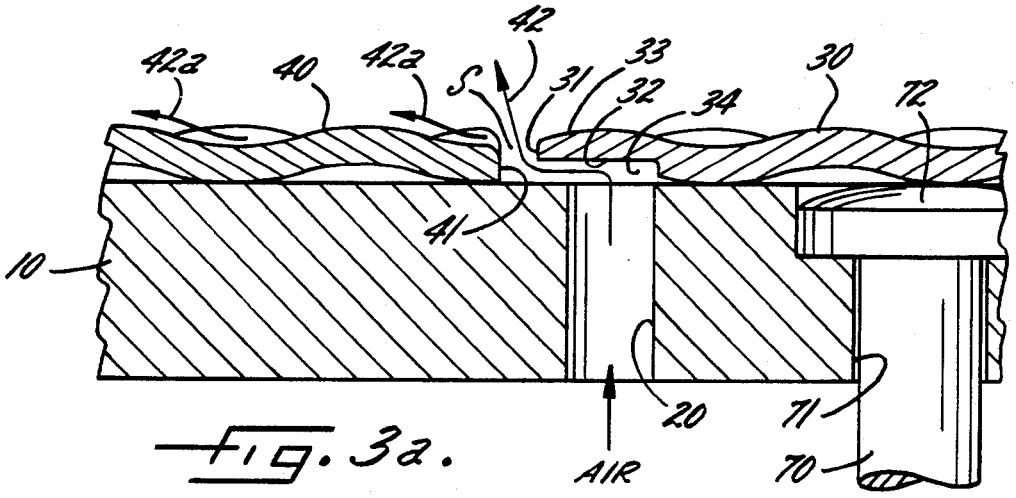

FIG. 3*a* is a further fragentary enlargement.

Figure 4:
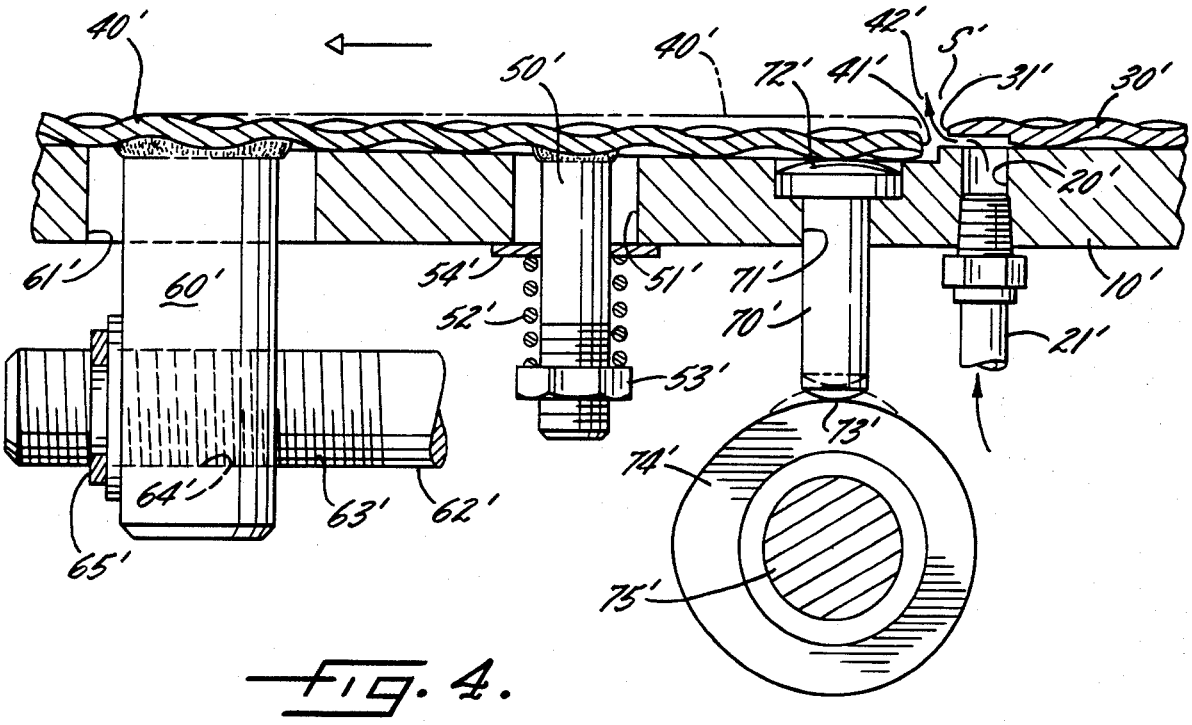

FIG. 4 is a view similar to FIG. 3 but showing a modified form of the present invention.

FIGS. 5A–5D are a series of diagrams showing, respectively, the device in its reference condition and in the various modes of adjustment.

Figure 6:
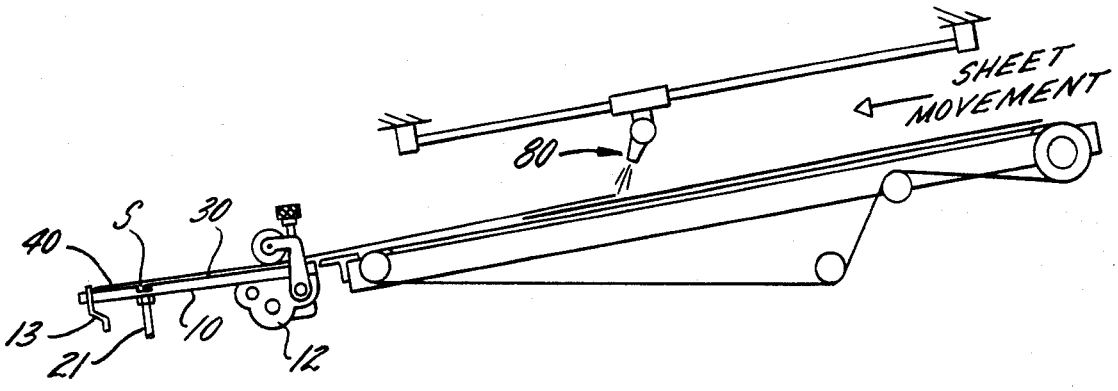

FIG. 6 is a simplified side elevation, at reduced scale, showing use of the device with sheets fed in an overlapped stream together with an auxiliary nozzle for separating the sheets and for preventing withdrawal of one sheet from affecting the following sheet.

While the invention has been described in connection with certain preferred embodiments, it will be understood that we do not intend to be limited to the particular embodiments shown but intend, on the contrary, to cover the various alternative and equivalent forms of the invention included within the spirit and scope of the appended claims.

Turning now to the drawings a feed table 10 having a front edge 11 is supported upon a frame 12, the feed table preferably being inclined downwardly in the direction of its front edge. A series of front stops 13 are cyclically interposed by an oscillating mechanism 13*a* connected to the press drive 14 for engagement of the front edges of successive sheets in registered position for pickup by a pickup device 15 which is known in the art and only diagrammatically shown. A sheet release mechanism 16 upstream of the feed table 10, and which is also connected to the press drive 14, serves to release the sheets synchronously at timed intervals, the sheets flowing downwardly along the table in the direction of the arrow. For the purpose of supplying compressed air to form an air blast, a port 20 extends upwardly through the feed table at a position spaced from the front edge by a distance which is relatively short as compared to the length of the feed table. The port is connected to a line 21 having a valve 22 which may be of the throttling type, and which receives air from a source 23.

In accordance with the present invention a rear feed plate is seated on the feed table upstream of the port having a continuous transversely extending front edge. A front feed plate is seated on the feed table downstream of the port and terminating in a continuous and transversely extending rear edge, the plates being substantially coplanar with their respective front and rear edges in proximity and uniformly spaced with respect to one another. The front edge portion of the rear feed plate is undercut to form an overhang which defines a transversely extending air-conducting cavity which overlaps the port so that compressed air is directed from the cavity at an angle upwardly and forwardly of the table to lubricate the passing sheet and to urge the sheet in the direction of the front stops. Means are provided for adjustably shifting at least one of the feed plates a short distance longitudinally of the table to vary the spacing between the edges of the plate thereby to vary the rate of discharge of the air and means are further provided for adjustably camming the edge portion of one of the feed plates with respect to the feed table through a short distance so that the front edge of the rear feed plate is variably higher than the rear edge of the front feed plate thereby to vary the angle of discharge of the air against the sheet. Thus, referring to FIGS. 1, 3, and 5, there is, seated on the feed table 10, a feed plate 30 having a front edge 31 which extends continuously in a direction transversely of the table. The front edge portion of the plate 30 is undercut as indicated at 32 (FIG. 3*a*) to produce an overhang 33 which defines a transversely extending air-conducting cavity 34 and which overlaps the port 20.

Seated on the feed table 10 in a position downstream, that is, forwardly of the port 20, is a front feed plate 40, having a rear edge 41 which is in proximity to the front edge 31 of the rear plate, the two edges being uniformly spaced with respect to one another. As a result the air blast indicated by the arrow 42, which is emitted from the slot S between the spaced edges 31, 41 of the plates, extends uniformly and continuously the width of the table.

For the purpose of varying the rate of air flow the valve 22, which in its simplest form is a throttle valve, but which may, if desired, be a pressure-reducing valve, manually adjusted. However, it is one of the aspects of the invention that means are provided for adjusting the spacing between the adjacent edges 31, 41 of the plates by making one of the plates 30, 40 relatively slidable with respect to the other while keeping the edges 31, 41 substantially parallel. In the preferred form of the invention it is the rear feed plate 30 which has provision for sliding back and forth in the direction of sheet movement. For the purpose of maintaining the rear feed plate 30 seated on the table, it is provided with a threaded stud 50 which is secured to the underside of the plate and which extends downwardly through a clearance opening 51. Encircling the stud at its lower end is a compression spring 52 maintained in its stressed condition by means of a nut 53 screwed onto the stud. Interposed between the spring and the underside of the table is a washer 54. The clearance opening 51 is preferably in the form of a slot to accommodate the range of adjusting movement of the feed plate, the washer 54 being oversized to provide an extensive bearing surface. Preferably the studs 50 and opening 51 are provided in pairs aligned with the direction of plate adjustment, companion studs being indicated at 50*a* in FIGS. 1 and 2.

For the purpose of adjusting the rear feed plate 30 back and forth in the direction of flow, a pillar 60 is secured to the underside of the plate 30 and extends downwardly through a clearance opening 61 in the form of a slot in the table. For engaging the pillar an adjusting screw 62 is provided under the table oriented in the direction of flow and threaded as indicated at 63 for screwing into a threaded opening 64 in the pillar 60. The range of adjustment is limited by a stop ring, or clip, 65 fixed to the end of the screw. The screw is captively supported in a pillow block 66 mounted on the frame 12. At the outer, or right-hand, end of the screw is an adjusting knob 67 preferably having a scale (not shown) cooperating with a fixed index 68. Preferably two of such adjusting assemblies are used spaced transversely with respect to the rear feed plate 30, the second such assembly being indicated at 60*a* in FIG. 2. The knobs 67, 67*a* thereof are preferably adjusted in unison and, for this purpose, they may be mechanically coupled together. However, it is also one of the features of the invention that, if desired, the knobs 67, 67*a* may be differentially adjusted so that the edges 31, 41 of the plates are non-parallel to one another resulting in a greater discharge of air at one end of the slot S than the other.

Figure 5A:
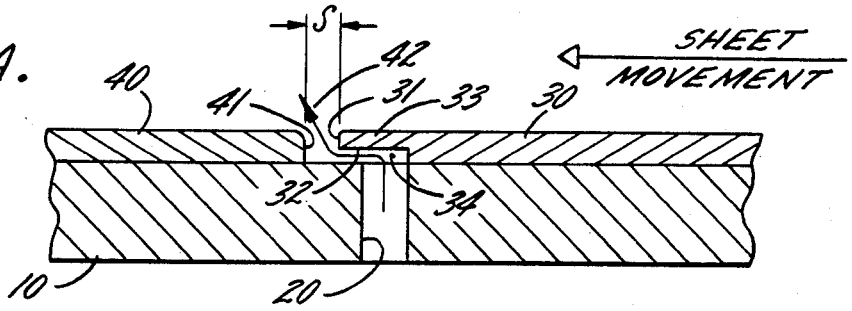
Figure 5B:
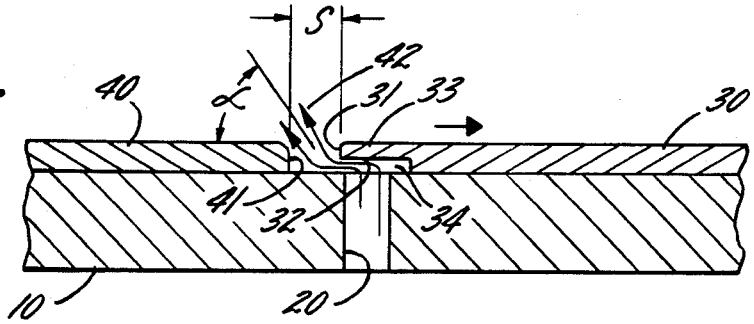

The effect of widening of the slot S will be noted upon comparing FIGS. 5A and 5B. In FIG. 5B the plate 30 has been retracted in the upstream direction resulting in a wider slot S and a greater rate of discharge of the compressed air therefrom as indicated by the double arrow. The direction of the air is, as shown, angled rather steeply at an angle $\alpha$.

Figure 1:
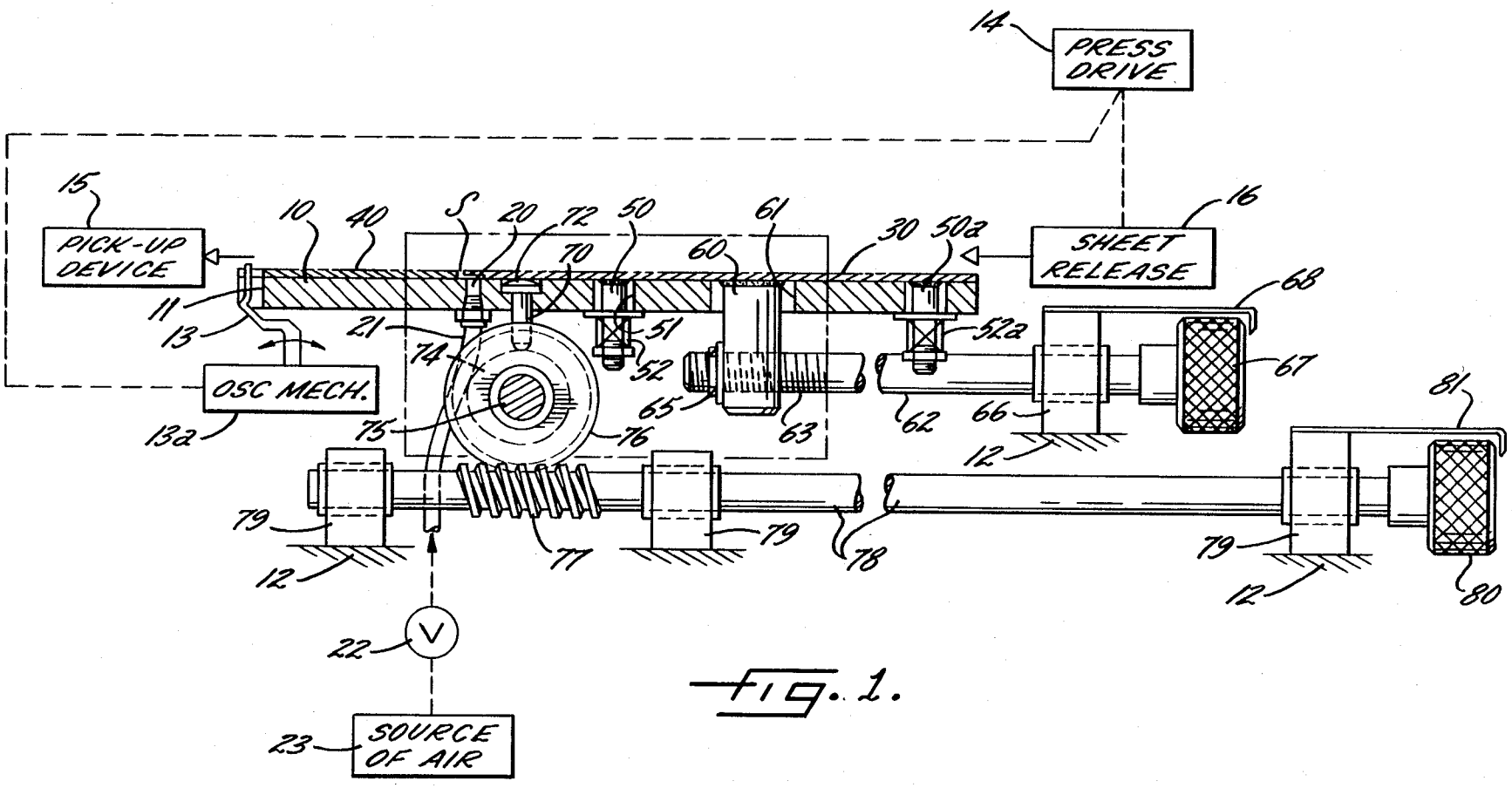
FIG. 1 is a simplified view of the present device in elevation as used along section line 1—1 in FIG. 2.
Figure 2:
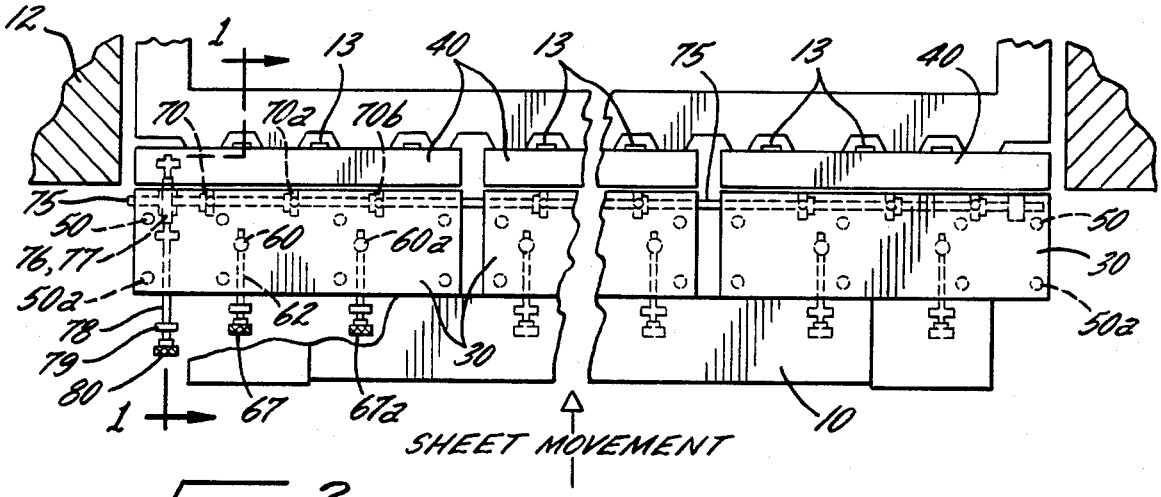
FIG. 2 is a partial top view of the device shown in FIG. 1.

In accordance with one of the further features of the present inventive combination, means are provided for adjustably camming the edge portion of one of the feed plates with respect to the feed table through a short distance so that the front edge of the rear feed plate is variably higher than the rear edge of the front plate thereby to vary the angle of discharge of the air against sheet. In the preferred form of the invention illustrated in FIGS. 1 and 3, it is the front edge portion of the rear feed plate which is subjected to the camming action. Thus, there is provided adjacent the front edge of the rear plate a plunger 70 which extends downwardly through a clearance opening 71 in the table and which has an upper end 72 which bears against the plate and a lower end 73 which serves as a cam follower, bearing against a cam 74 of oval shape mounted upon a shaft 75. As shown in FIG. 1, the shaft carries a worm wheel 76 which engages a worm 77 which is at the end of a worm shaft 78. The worm shaft is captively mounted in pillow blocks 79 secured to the frame 12 of the device and carries at its outer end a manual adjusting knob 80 cooperating with a fixed pointer or index 81. Preferably the plungers 70 are provided in multiple spaced along the front edge of the rear feed plate as indicated at 70*a*, 70*b* in FIG. 2, with each plunger having a respective cam 74 in alignment with it and mounted upon a common cross shaft 75. As a result, turning the knob 80 brings about a simultaneous and equivalent adjustment of all of the plungers, thereby elevating the front edge portion of the rear feed plate to a uniform height above the table along its entire width.

Figure 5C:
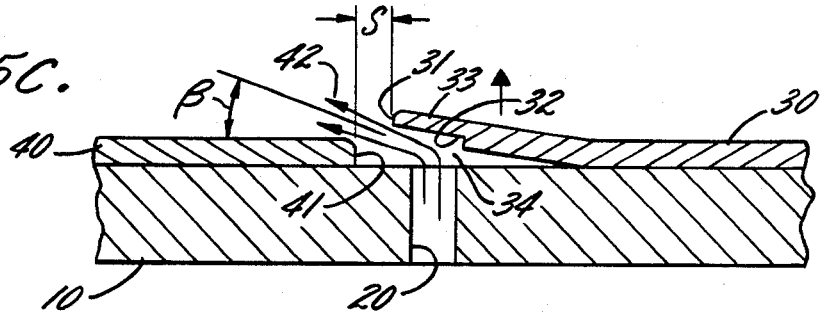

The effect of turning the adjusting knob 80 will be apparent upon comparing FIGS. 5A and 5C, FIG. 5A showing the reference condition. The feed plate 30 is preferably of sufficiently thin construction so that while the body portion of the plate remains seated upon the table by reason of the studs 50 and springs 52, the plate is bowingly deflected with the smooth curvature into the condition illustrated in FIG. 5C in which the compressed air blast issuing from the slot S, and which impinges upon the underside of the sheet, is at a shallower angle $\beta$ than where the plate occupies its flat reference position.

In a preferred embodiment of the invention, the rear feed plate 30 is provided in sections arranged on the frame side-by-side in a transverse direction, in which case the plunngers 70 associated with all of the plate sections engage respective cams 74 which are mounted upon the cross shaft 75 which extends the entire width of the table.

Figure 5D:
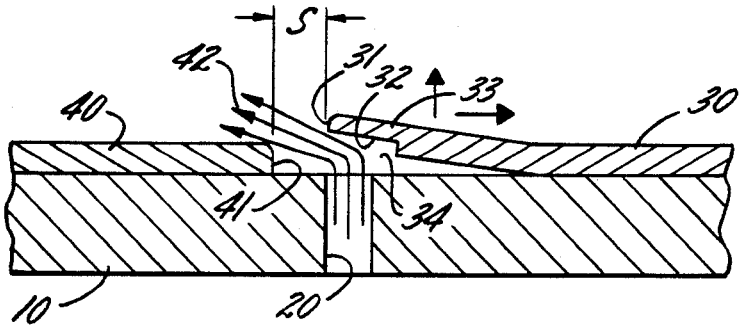

For the effect of making both types of adjustments simultaneously, that is, shifting and bowing of the plate, reference is made to FIG. 5D where it will be noted the effect is to produce a low angle of discharge combined with augmented flow.

In the embodiment of the invention illustrated in FIG. 3, the front edge of the rear feed plate is subjected to the camming action. However, in accordance with one of the aspects of the invention, the same effect may be achieved by camming the rear edge of the front feed plate as illustrated in FIG. 4, in which corresponding reference numerals have been used to indicate the corresponding parts with the addition of a prime. Thus, it will be noted in FIG. 4 that the front feed plate 40' is maintained in its seated position by a stud 50' which is kept under tension by a spring 52', a plurality of such studs and springs being used in transversely spaced relation. Shifting movement of the feed plate in a direction parallel to the flow is achieved by a pillar 60' which is threadingly engaged by a screw 62' which will be understood to be mounted in a pillow block 66 and under the manual control of an adjusting knob 67, cross reference being made to FIG. 1.

For the purpose of cammed adjustment of the rear edge 41' of the front plate, a plunger 70' is recessed in a clearance opening 71', the plunger engaging at its lower end a cam 74' mounted upon a cross shaft 75'.

The primary difference between the embodiment shown in FIG. 4 and that illustrated in FIG. 3 is that the controlled plate, in this case the front plate 40', occupies a normally recessed position in which the rear edge 41'lies below the front edge 31' of the rear plate 30', as shown in the full lines in FIG. 4. As the cam 74' is rotated to thrust the plunger 70' upwardly, the rear edge of the front plate is gradually raised into the dot-dashed reference position in which it is flush with the rear feed plate.

In accordance with the present invention, the feed plates, and particularly the front feed plate 40 is formed with a two-dimensional repeating pattern of (a) recesses of substantially equal depth and (b) protuberances of substantially equal height so as to define surface passages to accommodate the air flowing under the sheet. Such a pattern of recesses and protuberances may be formed by rolling a relatively thin sheet of stock between a pair of rollers having on their surface a two-dimensional pattern of recesses and protuberances, with each protuberance on one roller phased with a recess on the other. However, the two-dimensional pattern may be machined into the surface of the plates if desired, for example, by machining in the surface a two-dimensional pattern of grooves extending either at right angles to one another to form relatively upraised squares or at an angle to one another to create a two-dimensional pattern of diamond shaped lands. Regardless of whether the surface is a result of deformation by rollers or as a result of machining, the air escaping from the slot S in the form of the air blast (arrow 42 in FIG. 3*a*), and which is trapped under the sheet, may follow a path of exit (arrow 42*a*) between the protuberances while the sheet is supported either on, or very closely adjacent to, the crests of the protuberances. The result is to reduce the effect of thickness of the air cushion; indeed, where the sheet rests on the crests of the protuberances the effective air cushion is reduced to substantially zero thickness, the sheet being held down in contact with the protuberances by the suction effect, or Bernoulli effect, of the air stream, a phenomenon well understood by those skilled in the art. The effect in any event is to substantially eliminate the type of fluttering experienced in arrangements such as disclosed in the cited prior art patents along with the whistling which is often heard in the operation of the prior art devices.

In the above discussion it has been assumed that sheets are transported across the table in a continuous stream but spaced so as to be separate from one another. It may, be desired under some circumstances, as for example in presses of highest production rate, for the successive sheets to be shingled or overlapped. Where sheets are fed in the overlapping fashion, the rapid withdrawal of the leading edge of the registered sheet by the pickup device may, as a result of the overlap, tend to drag along the next following sheet thereby throwing it out of time. In order to ensure that removal of one sheet does not effect the one behind it, we preferably provide an auxiliary blower as indicated at 80 in FIG. 6. Preferably such blower consists of a plurality of closely spaced nozzles extending the width of the sheet or, alternatively, the blower may be in the form of a continuous slit extending across the width of the sheet and supplied by a suitable source of compressed air.

In operation with overlapping sheets, the front edge of the first sheet is engaged and held down by suction due to the air blast. Thus, any corrugations in the sheet material are obviated and the sheet is guided to the front stops by the conveying effect of the air blast. On reaching the front stops, the rear edge of the sheet comes into the range of the blower 80 and is subject to an air blast therefrom which passes as a film beneath the tail of the first sheet, separating the sheet from the next sheet so that there is no longer any risk of the second, or lower, sheet being entrained when the upper sheet is drawn off.

The term "camming" as used herein is not limited to achievement of height adjustment by use of the illustrated oval shaped cams and it will, on the contrary, be apparent to one skilled in the art that the edge of the feed plate may be moved in the vertical direction by other specific types of cams, wedges and the like, all of which are intended to be included within the scope of the term.

It will be apparent that the device described amply meets the objects of the invention. The air blast extending continuously along the width dimension of the sheet provides lubrication and propulsion as well as suction effect combined with close control of the sheet and freedom from fluttering, the latter being due in part to the modification of the air cushion and support of the sheet upon the spaced, two-dimensional pattern of protuberances. By reason of the dual adjustment, the rate of air flow and the angle at which the air blast strikes the underside of the sheet may be independently varied over wide limits thereby accommodating the device to a wide variety of paper stock ranging all the way from tissue to cardboard and having a wide range of surface texture. Moreover, the device is capable of feeding paper in a wide range of condition including moisture content an tendency toward waviness or curling. All compensatory adjustments may be made conveniently and promptly, even during operation.

What is claimed is:

1. A sheet feeding assembly for a printing press comprising, in combination, a feed table having a front edge, a set of front stops cyclically interposable at the front edge of the table, the table being longitudinally inclined downwardly in the direction of its front edge, means for releasing a sheet so that it travels toward the front edge where it is temporarily retained in a registered position by the front stops, a port extending upwardly through the feed table at a position spaced from the front edge by a distance which is relatively short as compared to the length of the feed table, the port being connected to a source of compressed air, a rear feed plate seated on the feed table upstream of the port and having a front edge portion terminating in a transversely extending front edge, a front feed plate seated on the feed table downstream of the port and having a rear edge portion terminating in a transversely extending rear edge, the plates being substantially coplanar with their respective front and rear edges in proximity and uniformly spaced with respect to one another, the front edge portion of the rear feed plate being undercut to form an overhang which defines a transversly extending air conducting cavity and which overlaps the port so that air is directed from the cavity at an angle upwardly and forwardly of the table to lubricate the passing sheet and to urge the sheet in the direction of the front stops, means for adjustably shifting at least one of the feed plates a short distance longitudinally of the table to vary the spacing between the edges of the plates thereby to vary the rate of discharge of the air, and means for adjustably camming the said edge portion of one of the feed plates with respect to the feed table through a short distance so that the front edge of the rear feed plate is variably higher than the rear edge of the front feed plate thereby to vary the angle of discharge of the air against the sheet.

2. A sheet feeding assembly for a printing press comprising, in combination a feed table having a front edge, a set of front stops cyclically interposable at the front edge of the table, the table being longitudinally inclined downwardly in the direction of its front edge, means for releasing a sheet so that it travels towards the front edge of the table where it is temporarily retained in a registered position by the front stops, a port extending upwardly through the feed table at a position spaced from the front edge by a distance which is relatively short as compared to the length of the feed table, the port being connected to a source of compressed air, a rear feed plate seated on the feed table upstream of the port and having a front edge portion terminating in a transversely extending front edge, a front feed plate seated on the feed table downstream of the port and having a rear edge portion terminating in a transversely extending rear edge, the plates being substantially coplanar with their respective front and rear edges in proximity and uniformly spaced with respect to one another, the front edge portion of the rear feed plate being undercut to form an overhang which defines a transversely extending air conducting cavity and which overlaps the port so that air is directed from the cavity at an angle upwardly and forwardly of the table to lubricate the passing sheet and to urge the sheet in the direction of the front stops, means for varying the rate of discharge of the air through the port, and adjustable means for upwardly camming the front edge portion of the rear feed plate with respect to the feed table through a short distance so that the front edge of the rear feed plate is variably higher than the rear edge of the front feed plate thereby to vary the angle of discharge of the air against the sheet.

3. The combination as claimed in claim 1 or in claim 2 in which the port is formed of a row of openings spaced along the cavity defined by the overhang so that air is discharged at a substantially equal rate along the cavity and over the entire width of the sheet.

4. The combination as claimed in claim 1 or in claim 2 in which the feed plates are formed with a two-dimensional repeating pattern of (a) recesses of substantially equal depth and (b) protuberances of equal height which support the sheet, the pattern thereby defining surface passages for air flowing under the sheet.

5. The combination as claimed in claim 1 or in claim 2 in which the feed plates are roll-formed with a two-dimensional repeating pattern of (a) recesses of substantially equal depth and (b) protuberances of equal height which support the sheet, the pattern thereby defining surface passages for air flowing under the sheet, the feed plates being flat and sufficiently thin so that when the edge portion thereof is engaged by the camming means the engaged plate undergoes smoothly bowed deflection.

6. The combination as claimed in claim 1 in which means are provided for holding the shiftable plate seated on the table including studs secured to the underside of the plate and extending downwardly through clearance openings in the table, compression springs encircling the studs and bearing against the underside of the table, the clearance openings being sufficiently large as to accommodate the adjustable shifting movement of the plate.

7. The combination as claimed in claim 1 in which the shifting means includes a pillar secured to the underside of the plate and extending downwardly through a clearance opening in the table, an adjusting screw under the table and extending parallel thereto, the adjusting screw engaging the pillar for adjustably moving the pillar in the desired direction of shifting movement of the plate.

8. The combination as claimed in claim 1 or in claim 2 in which the front edge portion of the rear feed plate has a cutout of generally rectangular cross-section along its lower surface forming a stepped edge which obstructingly overlies the port thereby to change the direction of the air emanating from the port.

9. The combination as claimed in claim 1 or in claim 2 in which the means for adjustably camming the edge portion of the plate with respect to the feed table is in the form of a plurality of plungers extending downwardly through clearance openings in the table for engaging the edge portion of the plate at spaced intervals and cams under the table respectively aligned with the plungers and with manually controlled means for moving the cams in unison with one another to achieve a uniform elevation of the edge of the plate along the entire width thereof.

* * * * *